US011132963B2

(12) United States Patent
Yu et al.

(10) Patent No.: US 11,132,963 B2
(45) Date of Patent: Sep. 28, 2021

(54) DISPLAY PANEL, METHOD OF DRIVING DISPLAY PANEL, AND DISPLAY DEVICE

(71) Applicants: CHENGDU BOE OPTOELECTRONICS TECHNOLOGY CO., LTD., Chengdu (CN); BOE TECHNOLOGY GROUP CO., LTD., Beijing (CN)

(72) Inventors: Pengfei Yu, Beijing (CN); Tingliang Liu, Beijing (CN); Haigang Qing, Beijing (CN)

(73) Assignees: CHENGDU BOE OPTOELECTRONICS TECHNOLOGY CO., LTD., Chengdu (CN); BOE TECHNOLOGY GROUP CO., LTD., Beijing (CN)

( * ) Notice: Subject to any disclaimer, the term of this patent is extended or adjusted under 35 U.S.C. 154(b) by 20 days.

(21) Appl. No.: 16/643,963

(22) PCT Filed: Apr. 8, 2019

(86) PCT No.: PCT/CN2019/081752
§ 371 (c)(1),
(2) Date: Mar. 3, 2020

(87) PCT Pub. No.: WO2020/206589
PCT Pub. Date: Oct. 15, 2020

(65) Prior Publication Data
US 2021/0256921 A1 Aug. 19, 2021

(51) Int. Cl.
*G09G 3/36* (2006.01)
*G09G 3/3275* (2016.01)

(52) U.S. Cl.
CPC ..... *G09G 3/3607* (2013.01); *G09G 3/3275* (2013.01); *G09G 3/3688* (2013.01); *G09G 2300/0452* (2013.01)

(58) Field of Classification Search
CPC .. G09G 3/3607; G09G 3/3275; G09G 3/3688; G09G 2300/0452
See application file for complete search history.

(56) References Cited

U.S. PATENT DOCUMENTS

2007/0040764 A1 2/2007 Kim
2011/0025669 A1 2/2011 Kwak et al.
(Continued)

FOREIGN PATENT DOCUMENTS

CN 103871357 A 6/2014
CN 104464645 A 3/2015
(Continued)

OTHER PUBLICATIONS

First Chinese Office Action from Chinese Patent Application No. 201980000464.3 dated Jul. 1, 2021.

*Primary Examiner* — Kenneth B Lee, Jr.
(74) *Attorney, Agent, or Firm* — Dilworth & Barrese, LLP.; Michael J. Musella, Esq.

(57) ABSTRACT

A display panel, a method of driving a display panel, and a display device are disclosed. The display panel includes a signal applying circuit, the input circuit of the signal applying circuit includes a plurality of first input sub-circuits and a plurality of second input sub-circuits, and the shunt circuit of the signal applying circuit includes a plurality of first shunt sub-circuits and a plurality of second shunt sub-circuits. The first input sub-circuit transmits one of the first data signal and the second data signal to the first shunt sub-circuit. The second input sub-circuit transmits the third data signal to the second shunt sub-circuit. The first shunt sub-circuit transmits the first data signal or the second data sign alto the first output terminal or the second output terminal. The second shunt sub-circuit transmits the third data signal to the third output terminal or the fourth output terminal.

20 Claims, 7 Drawing Sheets

(56) References Cited

U.S. PATENT DOCUMENTS

| | | | | |
|---|---|---|---|---|
| 2014/0307004 | A1* | 10/2014 | Roh | G09G 3/3208 345/690 |
| 2014/0354286 | A1* | 12/2014 | Kim | G09G 3/006 324/414 |
| 2016/0293077 | A1* | 10/2016 | Ma | G09G 3/006 |
| 2017/0076665 | A1 | 3/2017 | Kim et al. | |
| 2017/0345357 | A1 | 11/2017 | Kong et al. | |
| 2018/0075817 | A1 | 3/2018 | Kim et al. | |
| 2018/0182324 | A1 | 6/2018 | Lin | |
| 2019/0228730 | A1* | 7/2019 | Cong | G09G 3/3688 |

FOREIGN PATENT DOCUMENTS

| | | | |
|---|---|---|---|
| CN | 108806602 | A | 11/2018 |
| CN | 109036238 | A | 12/2018 |

* cited by examiner

DISPLAY PANEL, METHOD OF DRIVING DISPLAY PANEL, AND DISPLAY DEVICE

TECHNICAL FIELD

Embodiments of the present disclosure relate to a display panel, a method of driving a display panel, and a display device.

BACKGROUND

With the development of display technologies, various display panels have been used more and more widely. These display panels can provide users with colorful pictures and good visual experience. The display panel mainly includes two types, i.e., a liquid crystal display (LCD) panel and an organic light emitting diode (OLED) display panel, which can be applied to electronic devices having a display function, such as a mobile phone, a television, a notebook computer, a digital camera, an instrument, a virtual reality (VR) equipment, an augmented reality (AR) equipment, and the like.

SUMMARY

At least one embodiment of the present disclosure provides a display panel, which comprises a signal applying circuit; the signal applying circuit comprises an input circuit and a shunt circuit, the input circuit comprises a plurality of first input sub-circuits and a plurality of second input sub-circuits, and the shunt circuit comprises a plurality of first shunt sub-circuits and a plurality of second shunt sub-circuits; a first input sub-circuit of the plurality of first input sub-circuits is correspondingly connected to a first shunt sub-circuit of the plurality of first shunt sub-circuits, and is configured to receive a first data signal and a second data signal, and transmit one of the first data signal and the second data signal to the first shunt sub-circuit in response to a first control signal and a second control signal; a second input sub-circuit of the plurality of second input sub-circuits is correspondingly connected to a second shunt sub-circuit of the plurality of second shunt sub-circuits, and is configured to receive a third data signal, and transmit the third data signal to the second shunt sub-circuit in response to a third control signal; the first shunt sub-circuit comprises a first output terminal and a second output terminal, and the first shunt sub-circuit is configured to receive the first data signal or the second data signal, and is configured to transmit the first data signal from the first input sub-circuit or the second data signal from the first input sub-circuit to the first output terminal in response to a shunt control signal, or transmit the first data signal from the first input sub-circuit or the second data signal from the first input sub-circuit to the second output terminal in response to the shunt control signal; and the second shunt sub-circuit comprises a third output terminal and a fourth output terminal, and the second shunt sub-circuit is configured to receive the third data signal, and transmit the third data signal from the second input sub-circuit to the third output terminal or the fourth output terminal in response to the shunt control signal.

For example, the display panel provided by an embodiment of the present disclosure further comprises a pixel array, the pixel array comprises a plurality of first color sub-pixels, a plurality of second color sub-pixels, and a plurality of third color sub-pixels, sub-pixels in odd-numbered rows of the pixel array are cyclically arranged in an order of a first color sub-pixel, a third color sub-pixel, a second color sub-pixel, and the third color sub-pixel, and sub-pixels in even-numbered rows of the pixel array are cyclically arranged in an order of the second color sub-pixel, the third color sub-pixel, the first color sub-pixel, and the third color sub-pixel.

For example, the display panel provided by an embodiment of the present disclosure further comprises a plurality of data lines, and the plurality of data lines are correspondingly connected to columns of sub-pixels of the pixel array; the first output terminal is connected to a data line, which corresponds to a (4N−3)th column of sub-pixels, of the plurality of data lines, and is configured to provide the first data signal or the second data signal to the (4N−3)th column of sub-pixels; the second output terminal is connected to a data line, which corresponds to a (4N−1)th column of sub-pixels, of the plurality of data lines, and is configured to provide the first data signal or the second data signal to the (4N−1)th column of sub-pixels; the third output terminal is connected to a data line, which corresponds to a (4N−2)th column of sub-pixels, of the plurality of data lines, and is configured to provide the third data signal to the (4N−2)th column of sub-pixels; the fourth output terminal is connected to a data line, which corresponds to a (4N)th column of sub-pixels, of the plurality of data lines, and is configured to provide the third data signal to the (4N)th column of sub-pixels; and N is an integer greater than zero.

For example, in the display panel provided by an embodiment of the present disclosure, the first color sub-pixel is a blue sub-pixel, the second color sub-pixel is a red sub-pixel, and the third color sub-pixel is a green sub-pixel.

For example, in the display panel provided by an embodiment of the present disclosure, the first input sub-circuit comprises a first transistor and a second transistor; a gate electrode of the first transistor is connected to a first control signal terminal to receive the first control signal, a first electrode of the first transistor is connected to a first data signal terminal to receive the first data signal, and a second electrode of the first transistor is connected to the first shunt sub-circuit; and a gate electrode of the second transistor is connected to a second control signal terminal to receive the second control signal, a first electrode of the second transistor is connected to a second data signal terminal to receive the second data signal, and a second electrode of the second transistor is connected to the second electrode of the first transistor.

For example, in the display panel provided by an embodiment of the present disclosure, the second input sub-circuit comprises a third transistor; and a gate electrode of the third transistor is connected to a third control signal terminal to receive the third control signal, a first electrode of the third transistor is connected to a third data signal terminal to receive the third data signal, and a second electrode of the third transistor is connected to the second shunt sub-circuit.

For example, in the display panel provided by an embodiment of the present disclosure, the shunt control signal comprises a first shunt control signal and a second shunt control signal, the first shunt sub-circuit transmits the first data signal from the first input sub-circuit or the second data signal from the first input sub-circuit to the first output terminal in response to the first shunt control signal and the second shunt control signal, or transmits the first data signal from the first input sub-circuit or the second data signal from the first input sub-circuit to the second output terminal in response to the first shunt control signal and the second shunt control signal, and the second shunt sub-circuit transmits the third data signal from the second input sub-circuit to the third output terminal or the fourth output terminal in response to the first shunt control signal and the second shunt control signal.

For example, in the display panel provided by an embodiment of the present disclosure, the first shunt sub-circuit comprises a fourth transistor and a fifth transistor; a gate electrode of the fourth transistor is connected to a first shunt control signal terminal to receive the first shunt control signal, a first electrode of the fourth transistor is connected to the first input sub-circuit, and a second electrode of the fourth transistor is connected to the first output terminal; and a gate electrode of the fifth transistor is connected to a second shunt control signal terminal to receive the second shunt control signal, a first electrode of the fifth transistor is connected to the first electrode of the fourth transistor, and a second electrode of the fifth transistor is connected to the second output terminal.

For example, in the display panel provided by an embodiment of the present disclosure, the second shunt sub-circuit comprises a sixth transistor and a seventh transistor; a gate electrode of the sixth transistor is connected to a first shunt control signal terminal to receive the first shunt control signal, a first electrode of the sixth transistor is connected to the second input sub-circuit, and a second electrode of the sixth transistor is connected to the third output terminal; and a gate electrode of the seventh transistor is connected to a second shunt control signal terminal to receive the second shunt control signal, a first electrode of the seventh transistor is connected to the first electrode of the sixth transistor, and a second electrode of the seventh transistor is connected to the fourth output terminal.

For example, the display panel provided by an embodiment of the present disclosure further comprises at least one gate driving circuit, and the at least one gate driving circuit is configured to provide a plurality of gate scanning signals to perform line scanning on the pixel array.

For example, in the display panel provided by an embodiment of the present disclosure, the display panel is an organic light emitting diode display panel or a liquid crystal display panel.

At least one embodiment of the present disclosure further provides a display device, which comprises the display panel according to any one of the embodiments of the present disclosure.

At least one embodiment of the present disclosure further provides a method of driving the display panel according to any one of the embodiments of the present disclosure. The method comprises: providing the first control signal, the second control signal, the first data signal, and the second data signal, so as to enable the first input sub-circuit to respectively transmit the first data signal and the second data signal to the first shunt sub-circuit at different times in response to the first control signal and the second control signal, providing the shunt control signal, so as to enable the first shunt sub-circuit to transmit the first data signal from the first input sub-circuit or the second data signal from the first input sub-circuit to the first output terminal in response to the shunt control signal, or to enable the first shunt sub-circuit to transmit the first data signal from the first input sub-circuit or the second data signal from the first input sub-circuit to the second output terminal in response to the shunt control signal, and providing a gate scanning signal, so as to enable the first data signal to be written into a first color sub-pixel and enable the second data signal to be written into a second color sub-pixel; and providing the third control signal and the third data signal, so as to enable the second input sub-circuit to transmit the third data signal to the second shunt sub-circuit in response to the third control signal, and enable the second shunt sub-circuit to transmit the third data signal from the second input sub-circuit to the third output terminal or the fourth output terminal in response to the shunt control signal, the third data signal being written into a third color sub-pixel under control of the gate scanning signal.

For example, in the method of driving the display panel provided by an embodiment of the present disclosure, the shunt control signal comprises a first shunt control signal and a second shunt control signal, and the first shunt control signal and the second shunt control signal have a same waveform and have different phases.

For example, in the method of driving the display panel provided by an embodiment of the present disclosure, an effective pulse width interval of the gate scanning signal comprises a first sub-interval, a second sub-interval, and a third sub-interval, a first shunt control signal corresponding to the first sub-interval is an invalid level of the first shunt sub-circuit and the second shunt sub-circuit, a second shunt control signal corresponding to the first sub-interval is a valid level of the first shunt sub-circuit and the second shunt sub-circuit, a first shunt control signal corresponding to the second sub-interval is an invalid level of the first shunt sub-circuit and the second shunt sub-circuit, a second shunt control signal corresponding to the second sub-interval is an invalid level of the first shunt sub-circuit and the second shunt sub-circuit, a first shunt control signal corresponding to the third sub-interval is a valid level of the first shunt sub-circuit and the second shunt sub-circuit, and a second shunt control signal corresponding to the third sub-interval is an invalid level of the first shunt sub-circuit and the second shunt sub-circuit.

For example, in the method of driving the display panel provided by an embodiment of the present disclosure, effective pulse width intervals of gate scanning signals, which are provided to adjacent rows of sub-pixels of a pixel array of the display panel, have gap intervals.

BRIEF DESCRIPTION OF THE DRAWINGS

In order to clearly illustrate the technical solution of the embodiments of the present disclosure, the drawings of the embodiments will be briefly described in the following. It is obvious that the described drawings in the following are only related to some embodiments of the present disclosure and thus are not limitative of the present disclosure.

DETAILED DESCRIPTION

Figure 1:
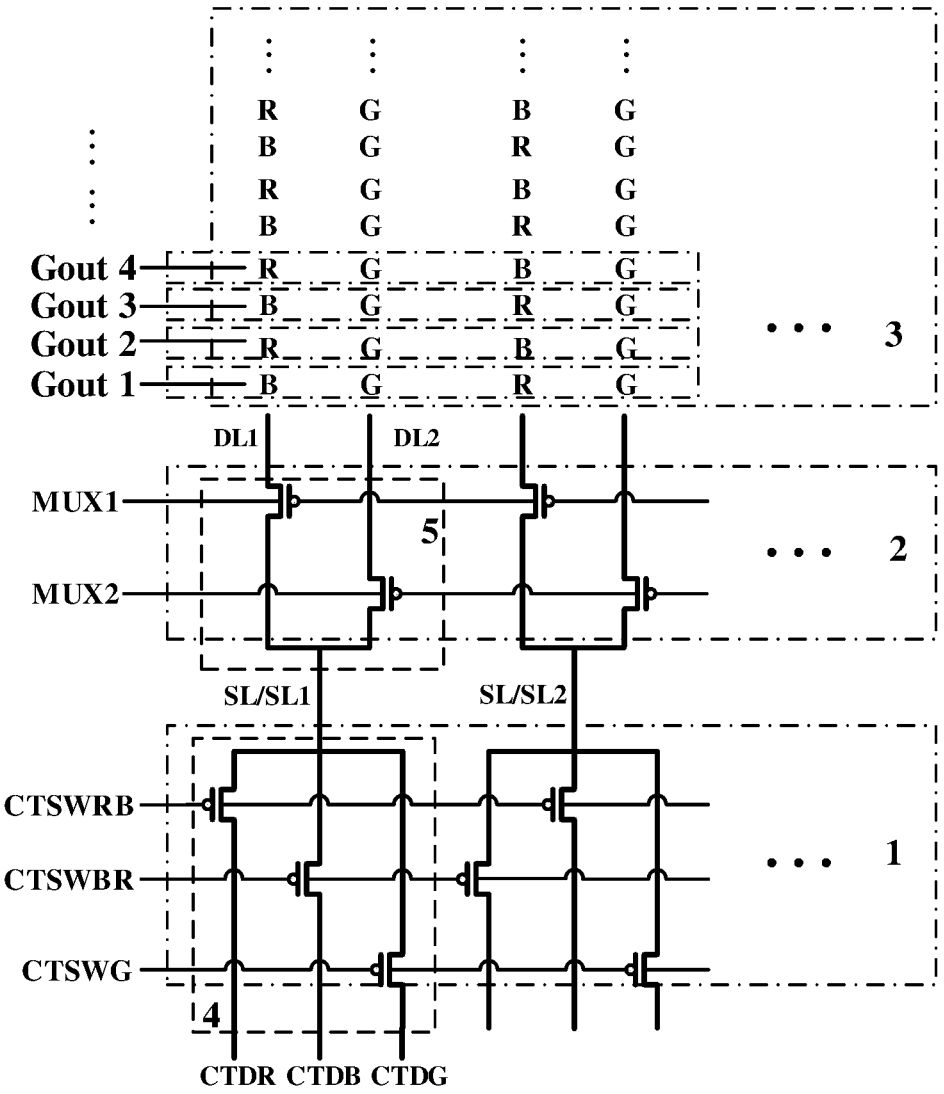
FIG. 1 is a schematic diagram of a signal applying circuit of a display panel.

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the description and the claims of the present application for disclosure, are not intended to indicate any sequence, amount or importance, but distinguish various components. Also, the terms such as "a," "an," etc., are not intended to limit the amount, but indicate the existence of at least one. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", "coupled", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

In the process of preparing a display panel (for example, an OLED display panel), the cell test (CT) needs to be performed on the screen that has been boxed. When performing the cell test, for example, CT units fabricated on an array substrate of the display panel are used to provide data signals to a pixel array, which achieve screen lighting tests of simple images such as red (R) image, green (G) image, blue (B) image, and gray image, etc., so as to detect and eliminate defective products in time. After the defective products are eliminated, the good products continue to carry out subsequent processes, so as to control the yield and cost.

In a conventional display panel, a multiplexer (MUX) unit is used to apply data signals to source signal lines (data lines), which can reduce the number of signal lines required for the cell test, effectively reduce the production cost, and be beneficial to reducing the size of the lower border of the display panel. For the display panel where the MUX unit is connected between the pixel array and the CT unit, signals of the MUX unit and signals of the CT unit need to work together during the cell test, resulting in complex signals and crowd signal timing. Due to the limited driving capability of the CT unit, it takes a certain amount of time to change the voltage of the signal line. However, in the case where there are many signals used in the cell test, the sequence of the signals and the rising edges and the falling edges of the signals need to avoid each other, resulting in insufficient time for the voltage change of the signal line, further resulting in insufficient writing of pixel signals of sub-pixels in an operable area (active area (AA), or display area), thereby causing the image display abnormal during the process of the cell test, which in turn affects the distinction between the good products and the defective products and is not conducive to controlling the yield and cost.

FIG. 1 is a schematic diagram of a signal applying circuit of a display panel. For example, as illustrated in FIG. 1, the signal applying circuit includes an input circuit 1 and a shunt circuit 2, a pixel array 3 in an AA of the display panel includes sub-pixels arranged in a plurality of rows and a plurality of columns, and the sub-pixels may be RGB sub-pixels. The input circuit 1 is, for example, a CT unit, and the shunt circuit 2 is, for example, a MUX unit. The input circuit 1 includes a plurality of input sub-circuits 4, the shunt circuit 2 includes a plurality of shunt sub-circuits 5, and the plurality of input sub-circuits 4 and the plurality of shunt sub-circuits 5 are connected in one-to-one correspondence. Each shunt sub-circuit 5 is connected to two data lines DL1 and DL2, so as to provide data signals to two adjacent columns of sub-pixels in the pixel array 3 in the AA. The data lines DL1 and DL2 are combined into one source signal line SL through the shunt circuit 2, thereby achieving the purpose of reducing the number of wirings.

During the process of the cell test, each input sub-circuit 4 receives first to third data signals CTDB, CTDR and CTDG, and the first to third data signals CTDB, CTDR and CTDG are written into corresponding sub-pixels under control of a first shunt control signal MUX1, a second shunt control signal MUX2, first to third control signals CTSWRB, CTSWBR, CTSWG, and gate scanning signals Gout1-Gout4, thereby achieving independent control of each sub-pixel. Here, in order to simplify the description, only four gate scanning signals Gout1-Gout4 are illustrated, but it should be understood that the number of the gate scanning signals is not limited thereto.

Figure 2:
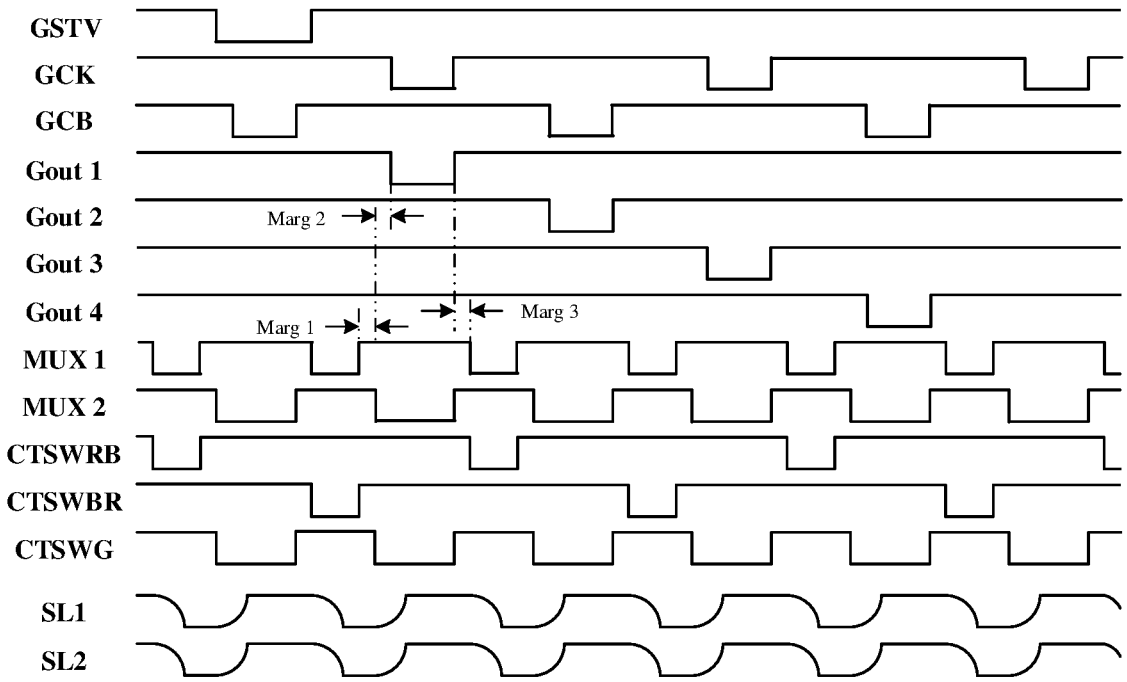
FIG. 2 is a timing diagram of signals of the signal applying circuit illustrated in FIG. 1.

FIG. 2 is a timing diagram of signals of the signal applying circuit as illustrated in FIG. 1. As illustrated in FIG. 1 and FIG. 2, the row scanning array (for example, a GOA circuit, not illustrated in the figure) uses a pair of clock signals GCK and GCB, and a trigger signal GSTV to generate the gate scanning signals Gout1-Gout4, which are sequentially turned on row by row. For example, when the gate scanning signal Gout 1 is at a low level, the gate scanning signal Gout 1 is in a turn-on state, and the corresponding sub-pixels of the first row of the pixel array 3 in the AA are in a signal writing phase. At this time, a gate electrode of a driving transistor of each sub-pixel in the first row of sub-pixels is written with a data signal provided by the corresponding data line DL1 or DL2. After the gate scanning signal Gout 1 becomes a high level, that is, after the gate scanning signal Gout 1 becomes a turn-off state, the voltage level of the data signal determines the light emission brightness of the corresponding sub-pixel. After all the gate scanning signals corresponding to the pixel array 3 are turned on once in sequence, the gate scanning signal Gout1 is turned on again to refresh the voltages of the gate electrodes of the driving transistors in the first row of sub-pixels. By repeating in this way, images are displayed.

Taking the display of a monochrome red image as an example, the working principle of the signal applying circuit illustrated in FIG. 1 is briefly described below. As illustrated in FIG. 1 and FIG. 2, in the case where the monochrome red image is displayed, all the red sub-pixels R in the pixel array 3 emit light, the gate electrodes of the corresponding driving transistors need to be written with a low voltage, for example, and all the gate electrodes of the driving transistors corresponding to the blue sub-pixels B and the green sub-pixels G need to be written with a high voltage. When the gate scanning signal Gout 1 is turned on, a high voltage is applied to the data line DL1 to write the high voltage into the blue sub-pixel B, and a high voltage is applied to the data line DL2 to write the high voltage into the green sub-pixel G. When the gate scanning signal Gout2 is turned on, a low voltage is applied to the data line DL1 to write the low voltage into the red sub-pixel R, and a high voltage is applied to the data line DL2 to write the high voltage into the green sub-pixel G. The odd-numbered rows of sub-pixels and the even-numbered rows of sub-pixels are written in this way repeatedly.

In order to change the voltages on the data lines DL1 and DL2 in the above manner, the second data signal CTDR needs to be kept at a low level, the first data signal CTDB and the third data signal CTDG remain high, and the first shunt control signal MUX1, the second shunt control signal MUX2, and the first to third control signals CTSWRB, CTSWBR, CTSWG are illustrated in FIG. 2. Regarding the specific control manner of the above-mentioned signals on the signal applying circuit, reference may be made to the conventional design, and details are not described here.

Each source signal line SL corresponds to three data signals (that is, the first to third data signals CTDB, CTDR, and CTDG), and further corresponds to two data lines DL1 and DL2. The two columns of sub-pixels corresponding to the data lines DL1 and DL2 include sub-pixels of three colors, so the signals are relatively complicated, and the timing of the signals is crowded.

Due to the limited signal driving capability used in the process of the cell test, delay of the signal is large. In an actual circuit, the rising edges and the falling edges of all signals in FIG. 2 are not absolutely vertical (FIG. 2 illustrates the rising edges and the falling edges as vertical for clarity), and a certain interval needs to be provided between turn-on period of the signals. For example, a first gap interval Marg 1, a second gap interval Marg2, and a third gap interval Marg3 in FIG. 2 need to be provided. The first gap interval Marg 1 and the third gap interval Marg3 need to be large enough to ensure that the second shunt control signal MUX2 is completely turned off when the first shunt control signal MUX1 is turned on, or the first shunt control signal MUX1 is completely turned off when the second shunt control signal MUX2 is turned on, thereby enabling the data lines DL1 and DL2 not to interfere with each other. Here, "turned on" means that the corresponding signal becomes a valid level, and "turned off" means that the corresponding signal becomes an invalid level, which is the same in the following and will not be described again. The sum of the widths of the first gap interval Marg 1 and the second gap interval Marg2 needs to be large enough to ensure that the voltage on the data line DL1 completes the transition before the gate scanning signal is turned on. The actual effective data writing time of each sub-pixel is limited by each gap interval. In the case where the gap interval is too small or too large, the image of the CT may be abnormal. In order to find an appropriate gap interval, repeated testing is required, which brings inconvenience to the process of the cell test.

At least one embodiment of the present disclosure provides a display panel, a method of driving a display panel, and a display device. The display panel can simplify signals, lower the difficulty of signal adjustment during the process of the cell test, and extend the signal writing time of the sub-pixel under the premise that the frequency is unchanged (for example, the frequency of the gate scanning signal is unchanged), and the image stability during the process of the cell test is improved.

Hereinafter, embodiments of the present disclosure are described in detail with reference to the accompanying drawings. It should be noted that the same reference numbers in different drawings are used to refer to the same elements that have been described.

At least one embodiment of the present disclosure provides a display panel, the display panel includes a signal applying circuit, the signal applying circuit includes an input circuit and a shunt circuit, the input circuit includes a plurality of first input sub-circuits and a plurality of second input sub-circuits, and the shunt circuit includes a plurality of first shunt sub-circuits and a plurality of second shunt sub-circuits. The first input sub-circuit is correspondingly connected to the first shunt sub-circuit, and is configured to receive a first data signal and a second data signal, and transmit one of the first data signal and the second data signal to the first shunt sub-circuit in response to a first control signal and a second control signal. The second input sub-circuit is correspondingly connected to the second shunt sub-circuit, and is configured to receive a third data signal and transmit the third data signal to the second shunt sub-circuit in response to a third control signal. The first shunt sub-circuit includes a first output terminal and a second output terminal, and the first shunt sub-circuit is configured to receive the first data signal or the second data signal, and is configured to transmit the first data signal from the first input sub-circuit or the second data signal from the first input sub-circuit to the first output terminal in response to a shunt control signal, or transmit the first data signal from the first input sub-circuit or the second data signal from the first input sub-circuit to the second output terminal in response to the shunt control signal. The second shunt sub-circuit includes a third output terminal and a fourth output terminal, and the second shunt sub-circuit is configured to receive the third data signal, and transmit the third data signal from the second input sub-circuit to the third output terminal or the fourth output terminal in response to the shunt control signal.

Figure 3:
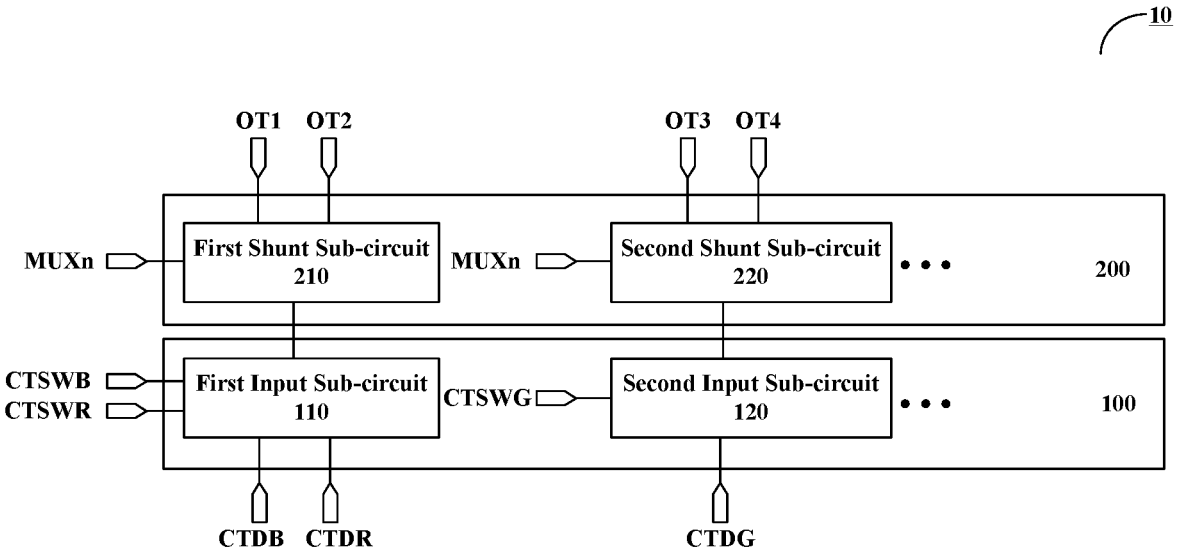
FIG. 3 is a schematic block diagram of a signal applying circuit of a display panel provided by some embodiments of the present disclosure.

FIG. 3 is a schematic block diagram of a signal applying circuit of a display panel provided by some embodiments of the present disclosure. As illustrated in FIG. 3, the display panel includes a signal applying circuit 10 and an AA, and the AA includes sub-pixels arranged in a plurality of rows and a plurality of columns, which is described below. The signal applying circuit 10 includes an input circuit 100 and a shunt circuit 200. The input circuit 100 includes a plurality of first input sub-circuits 110 and a plurality of second input sub-circuits 120. The shunt circuit 200 includes a plurality of first shunt sub-circuits 210 and a plurality of second shunt sub-circuits 220.

The first input sub-circuit 110 is correspondingly connected to the first shunt sub-circuit 210 (for example, connected in one-to-one correspondence), and is configured to receive a first data signal and a second data signal, and transmit one of the first data signal and the second data signal to the first shunt sub-circuit 210 in response to a first control signal and a second control signal. For example, the first input sub-circuit 110 is respectively connected to a first data signal terminal CTDB, a second data signal terminal CTDR, a first control signal terminal CTSWB, and a second control signal terminal CTSWR, so as to respectively receive the first data signal provided by the first data signal terminal CTDB, the second data signal provided by the second data signal terminal CTDR, the first control signal provided by the first control signal terminal CTSWB, and the second control signal provided by second control signal terminal CTSWR. For example, in an example, when the first control signal is at a valid level, the first data signal is transmitted to the first shunt sub-circuit 210; and when the second control signal is at a valid level, the second data signal is transmitted to the first shunt sub-circuit 210.

The second input sub-circuit 120 is correspondingly connected to the second shunt sub-circuit 220 (for example, connected in one-to-one correspondence), and is configured to receive a third data signal and transmit the third data signal to the second shunt sub-circuit 220 in response to a third control signal. For example, the second input sub-circuit 120 is respectively connected to a third data signal terminal CTDG and a third control signal terminal CTSWG, so as to respectively receive the third data signal provided by the third data signal terminal CTDG and the third control signal provided by the third control signal terminal CTSWG. For example, in an example, when the third control signal is at a valid level, the third data signal is transmitted to the second shunt sub-circuit 220.

The first shunt sub-circuit 210 includes a first output terminal OT1 and a second output terminal OT2. The first shunt sub-circuit 210 is configured to receive the first data signal or the second data signal, and is configured to transmit the first data signal from the first input sub-circuit 110 or the second data signal from the first input sub-circuit 110 to the first output terminal OT1 in response to a shunt control signal, or transmit the first data signal from the first input sub-circuit 110 or the second data signal from the first input sub-circuit 110 to the second output terminal OT2 in response to the shunt control signal. For example, the first shunt sub-circuit 210 is connected to a shunt control signal terminal MUXn to receive the shunt control signal. For example, the first data signal from the first input sub-circuit 110 may be transmitted to the first output terminal OT1 or the second output terminal OT2, and the second data signal from the first input sub-circuit 110 may also be transmitted to the first output terminal OT1 or the second output terminal OT2.

The second shunt sub-circuit 220 includes a third output terminal OT3 and a fourth output terminal OT4, and is configured to receive the third data signal, and transmit the third data signal from the second input sub-circuit 120 to the third output terminal OT3 or the fourth output terminal OT4 in response to the shunt control signal. For example, the second shunt sub-circuit 220 is connected to the shunt control signal terminal MUXn to receive the shunt control signal.

It should be noted that, in the embodiments of the present disclosure, the number of the first input sub-circuits 110, the second input sub-circuits 120, the first shunt sub-circuits 210 and the second shunt sub-circuits 220 is not limited, and may be determined according to actual requirements, for example, according to the size of the pixel array in the display panel, as long as the number of the first input sub-circuits 110 and the number of the first shunt sub-circuits 210 are equal, and the number of the second input sub-circuits 120 and the number of the second shunt sub-circuits 220 are equal. The first output terminal OT1, the second output terminal OT2, the third output terminal OT3, and the fourth output terminal OT4 can independently provide data signals to sub-pixels in different columns in the pixel array, so as to enable the sub-pixels to display desired gray levels.

Figure 4:
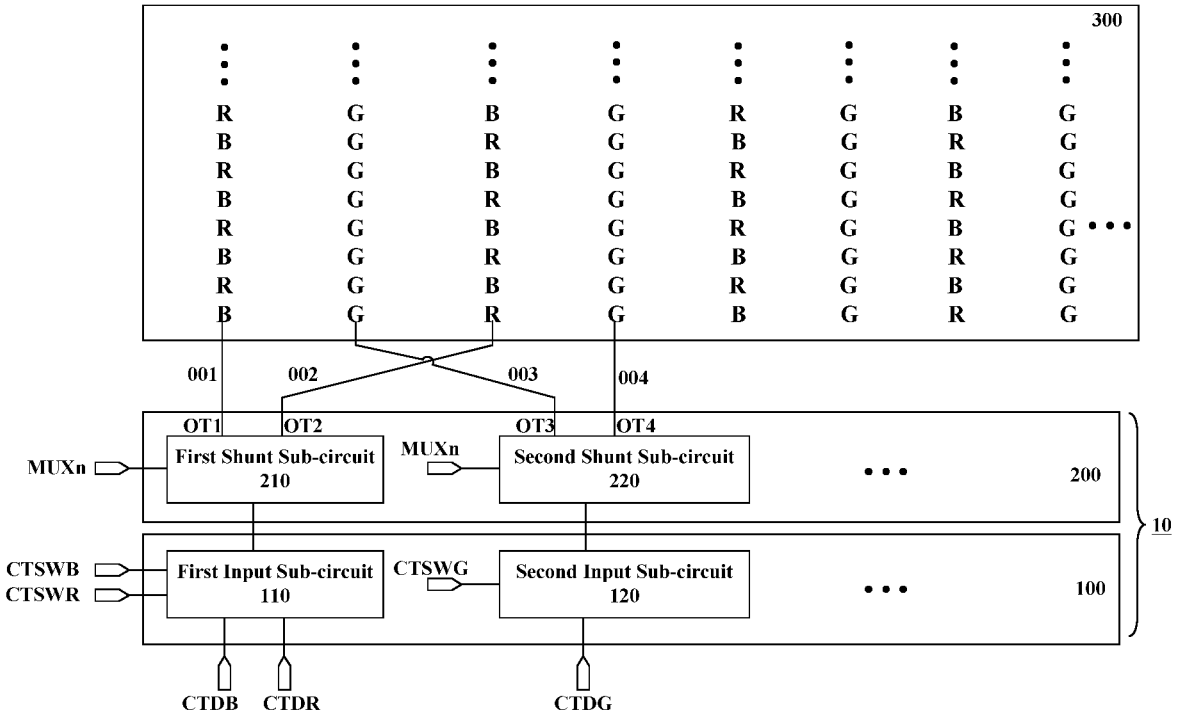
FIG. 4 is a schematic diagram of a connection between a pixel array and a signal applying circuit of a display panel provided by some embodiments of the present disclosure.

FIG. 4 is a schematic diagram of a connection between a pixel array and a signal applying circuit of a display panel provided by some embodiments of the present disclosure. As illustrated in FIG. 4, the display panel further includes a pixel array 300. The pixel array 300 includes a plurality of first color sub-pixels B, a plurality of second color sub-pixels R and a plurality of third color sub-pixels G. For example, sub-pixels in odd-numbered rows of the pixel array 300 are cyclically arranged in an order of the first color sub-pixel B, the third color sub-pixel G, the second color sub-pixel R, and the third color sub-pixel G; and sub-pixels in even-numbered rows of the pixel array 300 are cyclically arranged in an order of the second color sub-pixel R, the third color sub-pixel G, the first color sub-pixel B, and the third color sub-pixel G. For example, the pixel array 300 is the pentile pixel array which is widely used.

The display panel further includes a plurality of data lines 001-004, and the plurality of data lines 001-004 are correspondingly connected to the plurality of columns of sub-pixels of the pixel array 300. Here, for convenience of illustration, only four data lines are illustrated in FIG. 4, but it should be understood that the number of data lines is not limited thereto, and may be any number, for example, equal to the number of the columns of the pixel array 300.

For example, the first output terminal OT1 is connected to the data line 001 corresponding to a (4N−3)th column of sub-pixels (for example, the first column of sub-pixels), and is configured to provide the first data signal or the second data signal to the (4N−3)th column of sub-pixels. The second output terminal OT2 is connected to the data line 002 corresponding to a (4N−1)th column of sub-pixels (for example, the third column of sub-pixels), and is configured to provide the first data signal or the second data signal to the (4N−1)th column of sub-pixels. N is an integer greater than zero. For example, the first data signal is a data signal that needs to be written into the first color sub-pixel B, and the second data signal is a data signal that needs to be written into the second color sub-pixel R.

For example, the third output terminal OT3 is connected to the data line 003 corresponding to a (4N−2)th column of sub-pixels (for example, the second column of sub-pixels), and is configured to provide the third data signal to the (4N−2)th column of sub-pixels. The fourth output terminal OT4 is connected to the data line 004 corresponding to a (4N)th column of sub-pixels (for example, the fourth column of sub-pixels), and is configured to provide the third data signal to the (4N)th column of sub-pixels. For example, the third data signal is a data signal that needs to be written into the third color sub-pixel G.

Because the sub-pixels in odd-numbered columns (for example, the sub-pixels in the first column and the third column) include only the first color sub-pixels B and the second color sub-pixels R, the first shunt sub-circuit 210 connected to the sub-pixels in odd-numbered columns only needs to transmit the first data signal and the second data signal. Because the sub-pixels in even-numbered columns (for example, the sub-pixels in the second column and the fourth column) include only the third color sub-pixels G, the second shunt sub-circuit 220 connected to the sub-pixels in even-numbered columns only needs to transmit the third data signal. Compared with the shunt sub-circuit 5 in the conventional signal applying circuit illustrated in FIG. 1, the signals transmitted by the first shunt sub-circuit 210 and the second shunt sub-circuit 220 in the embodiments of the present disclosure are simplified, which lowers the difficulty of signal adjustment during the process of the cell test.

It should be noted that FIG. 4 only illustrates the connection manner of four columns of sub-pixels and the signal applying circuit 10, and the other columns of sub-pixels may be connected to the signal applying circuit 10 in a similar manner. For example, every four columns of sub-pixels and one first input sub-circuit 110, one second input sub-circuit 120, one first shunt sub-circuit 210 and one second shunt sub-circuit 220 are a group, and are connected correspondingly in the above connection manner, and so on, which is not repeated here.

For example, in an example, the first color sub-pixel B is a blue sub-pixel, the second color sub-pixel R is a red sub-pixel, and the third color sub-pixel G is a green sub-pixel. Of course, the embodiments of the present disclosure are not limited to this, and the first color sub-pixel B, the second color sub-pixel R, and the third color sub-pixel G may be sub-pixels of any colors, which may be determined according to actual needs.

Figure 5:
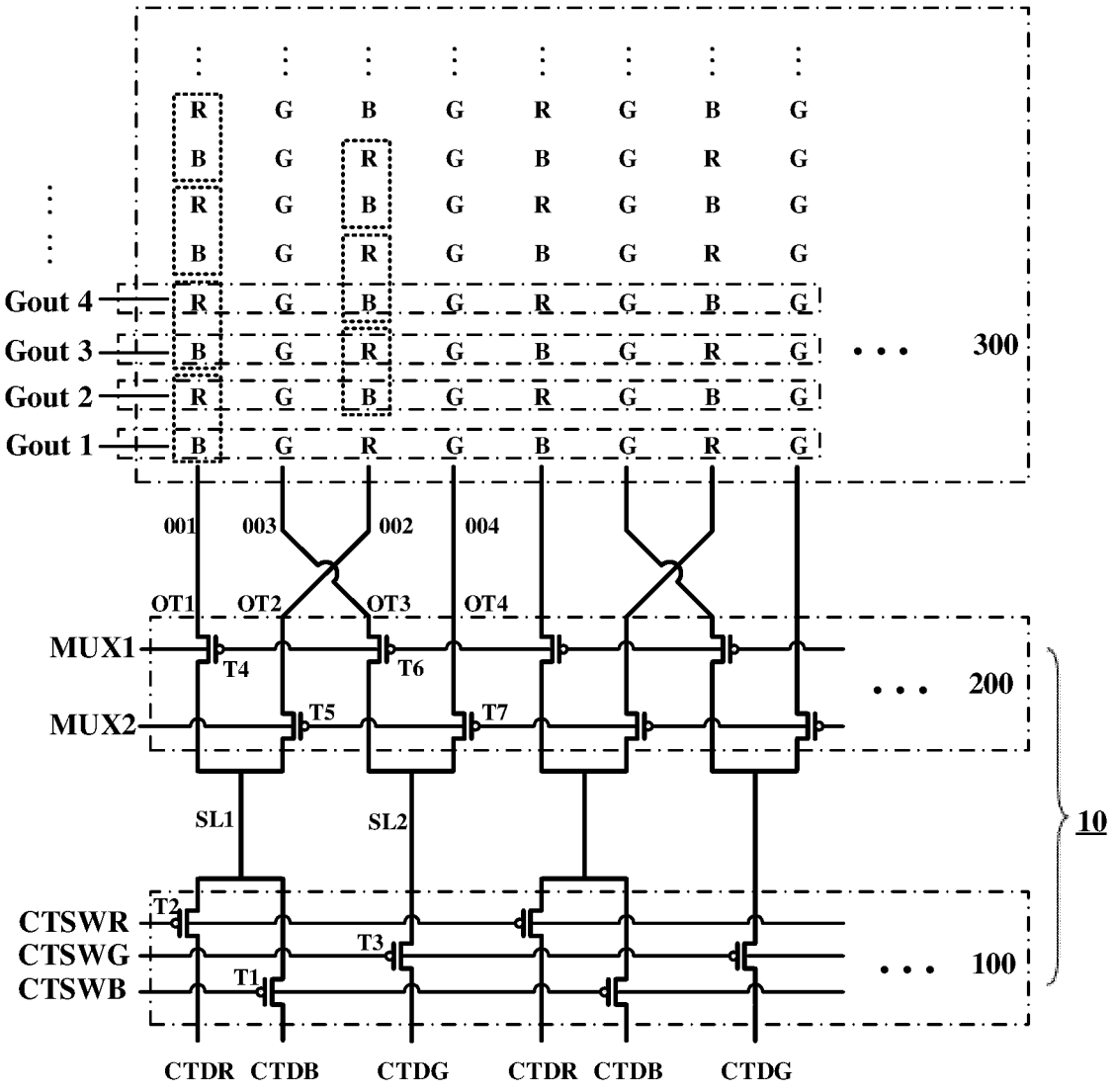
FIG. 5 is a circuit diagram of a specific implementation example of the signal applying circuit illustrated in FIG. 4.

FIG. 5 is a circuit diagram of a specific implementation example of the signal applying circuit as illustrated in FIG. 4. For example, as illustrated in FIG. 5, the first input sub-circuit 110 is implemented as a first transistor T1 and a second transistor T2. A gate electrode of the first transistor T1 is connected to the first control signal terminal CTSWB to receive the first control signal, a first electrode of the first transistor T1 is connected to the first data signal terminal CTDB to receive the first data signal, and a second electrode of the first transistor T1 is connected to the first shunt sub-circuit 210 through a first source signal line SL1. A gate electrode of the second transistor T2 is connected to the second control signal terminal CTSWR to receive the second control signal, a first electrode of the second transistor T2 is connected to the second data signal terminal CTDR to receive the second data signal, and a second electrode of the second transistor T2 is connected to the second electrode of the first transistor T1. It should be noted that the embodiments of the present disclosure are not limited thereto, and the first input sub-circuit 110 may also be a circuit composed of other components.

For example, the second input sub-circuit 120 is implemented as a third transistor T3. A gate electrode of the third transistor T3 is connected to the third control signal terminal CTSWG to receive the third control signal, a first electrode of the third transistor T3 is connected to the third data signal terminal CTDG to receive the third data signal, and a second electrode of the third transistor T3 is connected to the second shunt sub-circuit 220 through a second source signal line SL2. It should be noted that the embodiments of the present disclosure are not limited thereto, and the second input sub-circuit 120 may also be a circuit composed of other components.

For example, the foregoing shunt control signal includes a first shunt control signal and a second shunt control signal, and accordingly, the foregoing shunt control signal terminal MUXn includes a first shunt control signal terminal MUX1 and a second shunt control signal terminal MUX2, which provide the first shunt control signal and the second shunt control signal, respectively. The first shunt sub-circuit 210 transmits the first data signal from the first input sub-circuit 110 or the second data signal from the first input sub-circuit 110 to the first output terminal OT1 in response to the first shunt control signal and the second shunt control signal, or transmits the first data signal from the first input sub-circuit 110 or the second data signal from the first input sub-circuit 110 to the second output terminal OT2 in response to the first shunt control signal and the second shunt control signal. The second shunt sub-circuit 220 transmits the third data signal from the second input sub-circuit 120 to the third output terminal OT3 or the fourth output terminal OT4 in response to the first shunt control signal and the second shunt control signal.

For example, the first shunt sub-circuit 210 is implemented as a fourth transistor T4 and a fifth transistor T5. A gate electrode of the fourth transistor T4 is connected to the first shunt control signal terminal MUX1 to receive the first shunt control signal, a first electrode of the fourth transistor T4 is connected to the first input sub-circuit 110 through the first source signal line SL1, and a second electrode of the fourth transistor T4 is connected to the first output terminal OT1. A gate electrode of the fifth transistor T5 is connected to the second shunt control signal terminal MUX2 to receive the second shunt control signal, a first electrode of the fifth transistor T5 is connected to the first electrode of the fourth transistor T4, and a second electrode of the fifth transistor T5 is connected to the second output terminal OT2. It should be noted that the embodiments of the present disclosure are not limited thereto, and the first shunt sub-circuit 210 may also be a circuit composed of other components.

For example, the second shunt sub-circuit 220 is implemented as a sixth transistor T6 and a seventh transistor T7. A gate electrode of the sixth transistor T6 is connected to the first shunt control signal terminal MUX1 to receive the first shunt control signal, a first electrode of the sixth transistor T6 is connected to the second input sub-circuit 120 through the second source signal line SL2, and a second electrode of the sixth transistor T6 is connected to the third output terminal OT3. A gate electrode of the seventh transistor T7 is connected to the second shunt control signal terminal MUX2 to receive the second shunt control signal, a first electrode of the seventh transistor T7 is connected to the first electrode of the sixth transistor T6, and a second electrode of the seventh transistor T7 is connected to the fourth output terminal OT4. It should be noted that the embodiments of the present disclosure are not limited thereto, and the second shunt sub-circuit 220 may also be a circuit composed of other components.

It should be noted that the transistors in the embodiments of the present disclosure can adopt thin film transistors, field-effect transistors or other switching devices having the similar characteristics. In the embodiments of the present disclosure, thin film transistors are adopted as an example for description. The source electrode and the drain electrode of the transistor adopted herein can be symmetrical in structure, so the source electrode and the drain electrode are not different in structure. In the embodiments of the present disclosure, in order to distinguish the two electrodes of the transistor other than the gate electrode, it is directly described that one of the two electrodes is the first electrode and the other electrode is the second electrode.

In addition, unless specifically stated, the transistors in the embodiments of the present disclosure are described by taking P-type transistors as an example. In this case, the first electrode of the transistor is the source electrode, and the second electrode is the drain electrode. It should be noted that the present disclosure includes but is not limited to this. For example, one or more transistors in the signal applying circuit provided by the embodiments of the present disclosure may also adopt N-type transistors. In this case, the first electrode of the transistor is the drain electrode, and the second electrode is the source electrode. For the different type of transistor, each electrode of this transistor need to be correspondingly connected with reference to each electrode of the corresponding transistor employed in examples of the embodiments of the present disclosure, and the corresponding voltage terminals may provide corresponding high voltages or low voltages. In the case where the N-type transistor is used, indium gallium zinc oxide (IGZO) can be used as the active layer of the thin film transistor, and compared with the case where low temperature poly silicon (LTPS) or amorphous silicon (such as hydrogenated amorphous silicon) is used as the active layer of the thin film transistor, it can effectively reduce the size of the transistor and prevent leakage current by using the IGZO.

Figure 6:
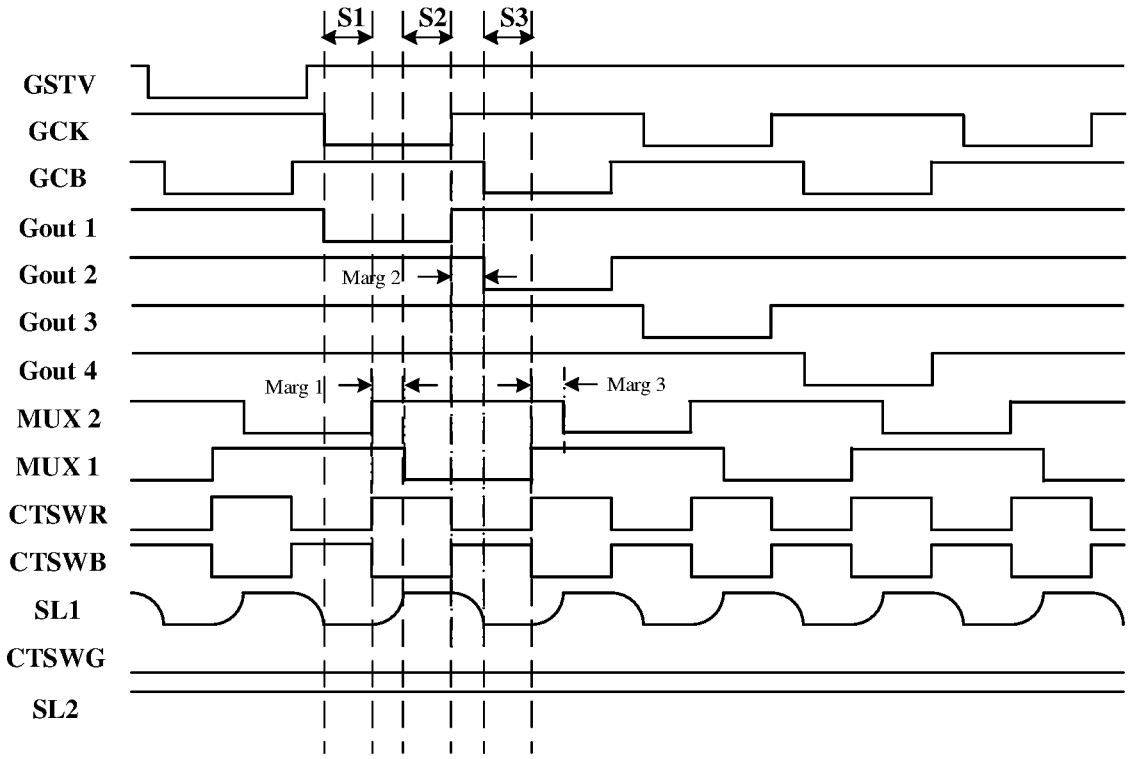
FIG. 6 is a timing diagram of signals of the signal applying circuit illustrated in FIG. 5.

FIG. 6 is a timing diagram of signals of the signal applying circuit illustrated in FIG. 5. The working principle of the signal applying circuit 10 illustrated in FIG. 5 is described below with reference to the timing diagram in FIG. 6. Here, each transistor is described by taking the P-type transistor as an example, and the embodiments of the present disclosure are not limited thereto.

In FIG. 6 and the following description, GSTV, GCK, GCB, Gout1, Gout2, Gout3, Gout4, MUX1, MUX2, CTSWR, CTSWB, CTSWG, SL1, SL2, etc. are used to indicate the corresponding signal terminals or signal lines, and further used to indicate corresponding signals. The following embodiments are the same and are not described again.

The following description takes the case where a monochrome red image is displayed as an example. In the case where the monochrome red image is displayed, all the second color sub-pixels R (for example, the red sub-pixels) in the pixel array 300 emit light, and for example, the gate electrodes of the corresponding driving transistors need to be written with a low voltage. Meanwhile, the gate electrodes of the driving transistors corresponding to all the first color sub-pixels B (for example, the blue sub-pixels) and all the third color sub-pixels G (for example, the green sub-pixels) need to be written with a high voltage.

For the third color sub-pixel G, because the pixel column including the third color sub-pixel G is only connected to the second shunt sub-circuit 220, and the second shunt sub-circuit 220 is connected to the second input sub-circuit 120, it is only necessary to keep the third control signal CTSWG at a turn-on state (for example, kept at a low level) to enable the third transistor T3 to be turned on, and to keep the third data signal CTDG at a high level. The signal transmitted by the second source signal line SL2 is at a high level, similarly, the second source signal lines SL2 connected to other second input sub-circuits 120 also transmit a high-level signal. No matter which one of the first shunt control signal MUX1 and the second shunt control signal MUX2 is turned on, that is, no matter which one of the sixth transistor T6 and the seventh transistor T7 is turned on, the corresponding data line 003 or 004 can be written with the high-level signal. When the gate scanning signals Gout1-Gout4 are sequentially turned on, the gate electrodes of the driving transistors of the third color sub-pixels G in a corresponding row are written with a high-level signal, so the third color sub-pixels G remain in a dark state.

For the first color sub-pixel B and the second color sub-pixel R, because the pixel column including the first color sub-pixel B and the second color sub-pixel R is only connected to the first shunt sub-circuit 210, and the first shunt sub-circuit 210 is connected to the first input sub-circuit 110, the first control signal CTSWB and the second control signal CTSWR need to be alternately turned on (for example, alternately to be at a low level) to alternately turn on the first transistor T1 and the second transistor T2, to keep the first data signal CTDB at a high level, and to keep the second data signal CTDR at a low level. As illustrated in FIG. 6, the first control signal CTSWB and the second control signal CTSWR have inverting phases. The first transistor T1 and the second transistor T2 are turned on alternately, and therefore the high level of the first data signal CTDB and the low level of the second data signal CTDR are alternately transmitted to the first source signal line SL1, so the signal of the first source signal line SL1 can be the signal illustrated in FIG. 6. Similarly, the signals of the first source signal lines SL1 connected to other first input sub-circuits 110 are also the signal illustrated in FIG. 6.

In a first phase S1, that is, in the first half of the turn-on process of the gate scanning signal Gout1, the second shunt control signal MUX2 is at a low level, and the fifth transistor T5 is turned on. At this time, the second control signal CTSWR is at a low level, the second transistor T2 is turned on, and the low level of the second data signal CTDR is transmitted to the first source signal line SL1. The fifth transistor T5 transmits the low-level signal of the first source signal line SL1 to the data line 002, thereby writing the low-level signal into the second color sub-pixel R located in the first row, and enabling the second color sub-pixel R to be at a bright state.

In a first gap interval Marg1, the second shunt control signal MUX2 becomes a high level, the fifth transistor T5 is turned off, and the parasitic capacitance stabilizes the signal on the data line 002 at a low level. The first control signal CTSWB becomes a low level, the first transistor T1 is turned on, the high level of the first data signal CTDB is transmitted to the first source signal line SL1, and the signal transmitted by the first source signal line SL1 changes from a low level to a high level. At this time, the second control signal CTSWR is at a high level, and the second transistor T2 is turned off.

In a second phase S2, that is, in the second half of the turn-on process of the gate scanning signal Gout1, the first shunt control signal MUX1 is at a low level, the fourth transistor T4 is turned on, and the high-level signal of the first source signal line SL1 is transmitted to the data line 001, thereby writing the high-level signal into the first color sub-pixel B located in the first row, and enabling the first color sub-pixel B to be at a dark state.

In a second gap interval Marg2, the gate scanning signal Gout1 becomes a high level, and the scanning of the first line ends. The second control signal CTSWR becomes a low level, the second transistor T2 is turned on, the low level of the second data signal CTDR is transmitted to the first source signal line SL1, and the signal transmitted by the first source signal line SL1 changes from a high level to a low level. At this time, the first control signal CTSWB is at a high level, and the first transistor T1 is turned off.

In a third phase S3, that is, in the first half of the turn-on process of the gate scanning signal Gout2, the first shunt control signal MUX1 is at a low level, the fourth transistor T4 is turned on, and the low-level signal of the first source signal line SL1 is transmitted to the data line 001, thereby writing the low-level signal into the second color sub-pixel R located in the second row, and enabling the second color sub-pixel R to be at a bright state.

In a third gap interval Marg3, the first shunt control signal MUX1 becomes a high level, the fourth transistor T4 is turned off, and the parasitic capacitance stabilizes the signal on the data line 001 at a low level. The first control signal CTSWB becomes a low level, the first transistor T1 is turned on, the high level of the first data signal CTDB is transmitted to the first source signal line SL1, and the signal transmitted by the first source signal line SL1 changes from a low level to a high level. At this time, the second control signal CTSWR is at a high level, and the second transistor T2 is turned off.

The subsequent processes are similar to the foregoing processes, and so on, which are not repeated here.

It should be noted that when the gate scanning signal Gout2 is turned on, the data line 002 is kept at a low level due to the parasitic capacitance, and the low-level signal is written into the first color sub-pixel B located in the second row immediately after the gate scanning signal Gout2 is turned on. After passing through the third gap interval Marg3, the second shunt control signal MUX2 becomes a low level, the fifth transistor T5 is turned on, and a high-level signal is written into the first color sub-pixel B. Because in the normal pixel circuit, during the process where the gate scanning signal Gout2 is turned on, that is, during the process of data writing, the sub-pixels of a corresponding row do not emit light. After the gate scanning signal Gout2 is turned off, the sub-pixels of the corresponding row present the corresponding brightness according to the voltage of the gate electrode. Therefore, although the gate electrode of the driving transistor corresponding to the first color sub-pixel B is at a low potential for a short time, the first color sub-pixel B cannot be lighten.

For the first half of the turn-on process of the gate scanning signals of the odd-numbered rows, the second shunt control signal MUX2 is at a low level, so the fifth transistor T5 is turned on, and the signal on the first source signal line SL1 is written into the second color sub-pixels R located in the odd-numbered rows. Before the signals are written into the second color sub-pixels R located in the odd-numbered rows, the signal on the first source signal line SL1 has completed the voltage conversion with the cooperation of the second control signal CTSWR and the second data signal CTDR.

For the second half of the turn-on process of the gate scanning signals of the odd-numbered rows, the first shunt control signal MUX1 is at a low level, so the fourth transistor T4 is turned on, and the signal on the first source signal line SL1 is written into the first color sub-pixels B located in the odd-numbered rows. Before the signals are written into the first color sub-pixels B located in the odd-numbered rows, the signal on the first source signal line SL1 has completed the voltage conversion in the first gap interval Marg1 with the cooperation of the first control signal CTSWB and the first data signal CTDB.

For the first half of the turn-on process of the gate scanning signals of the even-numbered rows, the first shunt control signal MUX1 is at a low level, so the fourth transistor T4 is turned on, and the signal on the first source signal line SL1 is written into the second color sub-pixels R located in the even-numbered rows. Before the signals are written into the second color sub-pixels R located in the even-numbered rows, the signal on the first source signal line SL1 has completed the voltage conversion in the second gap interval Marg2 with the cooperation of the second control signal CTSWR and the second data signal CTDR.

For the second half of the turn-on process of the gate scanning signals of the even-numbered rows, the second shunt control signal MUX2 is at a low level, so the fifth transistor T5 is turned on, and the signal on the first source signal line SL1 is written into the first color sub-pixels B located in the even-numbered rows. Before the signals are written into the first color sub-pixels B located in the even-numbered rows, the signal on the first source signal line SL1 has completed the voltage conversion with the cooperation of the first control signal CTSWB and the first data signal CTDB.

The low-level period of the first shunt control signal MUX1 coincides with the second half of the gate scanning signal of the odd-numbered row and coincides with the first half of the gate scanning signal of the next row (an even-numbered row). The low-level period of the second shunt control signal MUX2 coincides with the second half of the gate scanning signal of the even-numbered row and coincides with the first half of the gate scanning signal of the next row (an odd-numbered row).

According to FIG. 5, FIG. 6 and the above description, in the case where a monochrome red image is displayed, the signal written into the sub-pixels in even-numbered columns is a constant DC signal, and the switching frequency of the signal written into the sub-pixels in odd-numbered columns and the switching frequency of the corresponding shunt control signal (for example, the first shunt control signal MUX1 and the second shunt control signal MUX2) are reduced by half compared to the conventional signal as illustrated in FIG. 2. For example, as illustrated in FIG. 5, in the same column of sub-pixels, adjacent first color sub-pixel B and second color sub-pixel R in the dotted frame use a same turn-on period of the first shunt control signal MUX1 or a same turn-on period of the second shunt control signal MUX2 for data writing, thereby reducing the times of switching between the switching states of the shunt control signal (that is, the times of switching between the high level and the low level), and reducing the switching frequency of the shunt control signal. In addition, the first gap interval Marg1, the second gap interval Marg2, and the third gap interval Marg3 are larger, so each signal has sufficient time to perform voltage conversion, thereby lowering the difficulty of signal adjustment during the process of the cell test, extending the signal writing time of the sub-pixels under the premise that the frequency is constant (for example, the frequency of the gate scanning signal is constant), and improving the image stability during the process of the cell test.

It should be noted that, in the embodiments of the present disclosure, the signal applying circuit 10 may be used to write arbitrary data signals to the sub-pixels in the pixel array 300, so as to display a variety of images, such as a monochrome image, a multi-color image, or the like, which is not limited to display a monochrome red image. For example, in the case where a monochrome blue image needs to be displayed, the first shunt control signal MUX1 and the second shunt control signal MUX2 can be shifted by half a period, and the voltages of the corresponding first data signal CTDB and the corresponding second data signal CTDR is changed.

Figure 7:
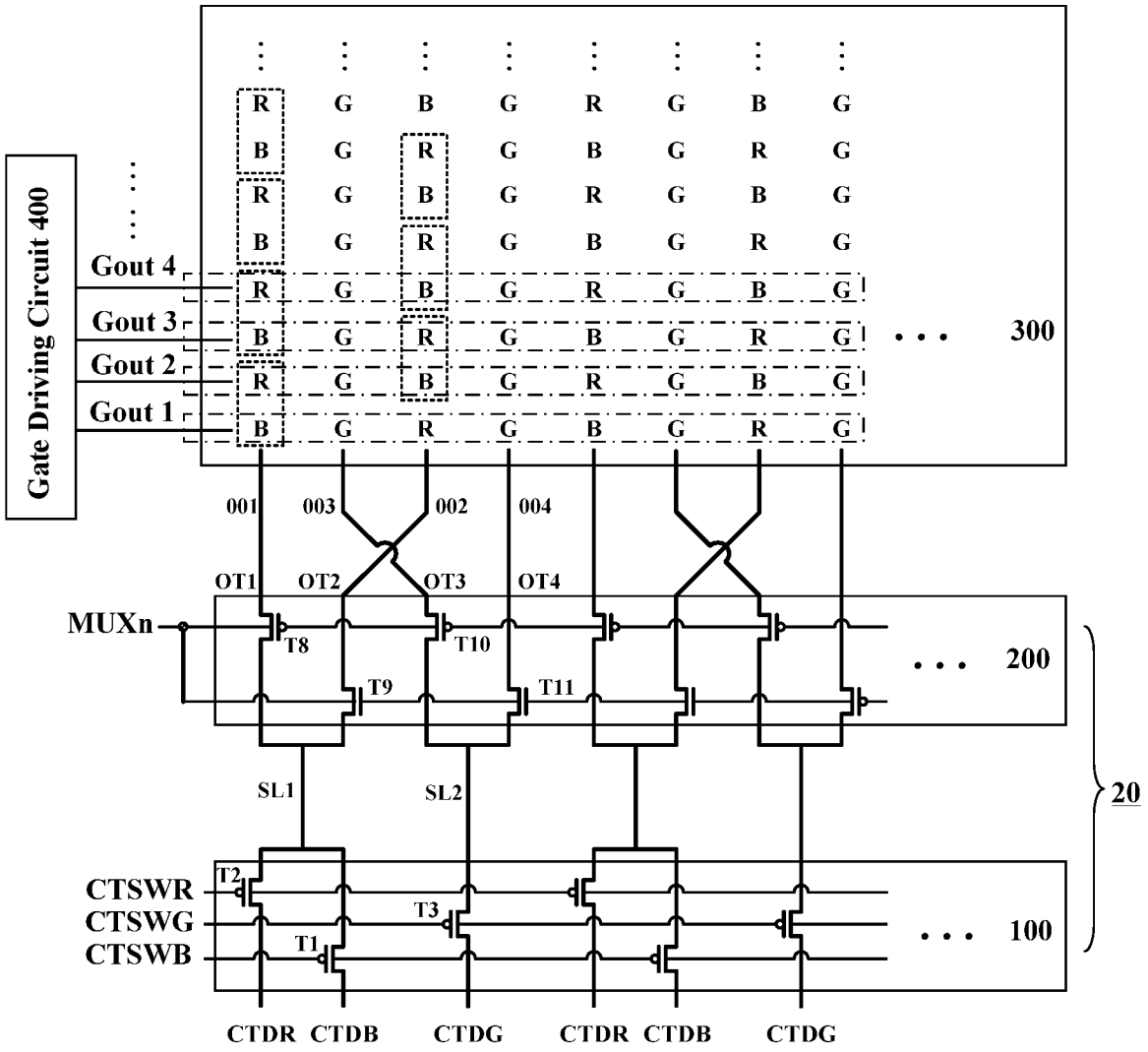
FIG. 7 is a circuit diagram of a specific implementation example of a signal applying circuit of another display panel provided by some embodiments of the present disclosure.

FIG. 7 is a circuit diagram of a specific implementation example of a signal applying circuit of another display panel provided by some embodiments of the present disclosure. The signal applying circuit 20 is basically the same as the signal applying circuit 10 illustrated in FIG. 5 except that the implementation manners of the first shunt sub-circuit 210 and the second shunt sub-circuit 220 are different.

In the present embodiment, the first shunt sub-circuit 210 is implemented as an eighth transistor T8 and a ninth transistor T9, and the second shunt sub-circuit 220 is implemented as a tenth transistor T10 and an eleventh transistor T11. A gate electrode of the eighth transistor T8, a gate electrode of the ninth transistor T9, a gate electrode of the tenth transistor T10, and a gate electrode of the eleventh transistor T11 are all connected to the shunt control signal terminal MUXn to receive the shunt control signal. The eighth transistor T8 and the ninth transistor T9 are different in type, and for example, the eighth transistor T8 is a P-type transistor, and the ninth transistor T9 is an N-type transistor. The tenth transistor T10 and the eleventh transistor T11 are different in type, and for example, the tenth transistor T10 is a P-type transistor, and the eleventh transistor T11 is an N-type transistor.

Figure 8:
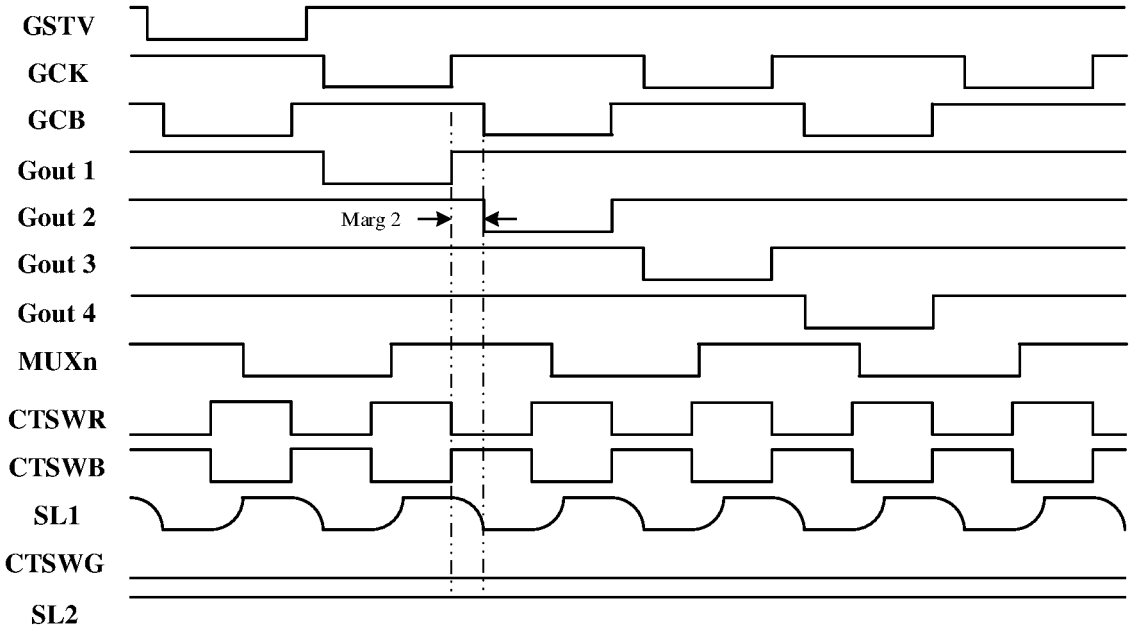
FIG. 8 is a timing diagram of signals of the signal applying circuit illustrated in FIG. 7.

FIG. 8 is a timing diagram of signals of the signal applying circuit illustrated in FIG. 7. For example, as illustrated in FIG. 8, the shunt control signal MUXn is a square wave signal. When the shunt control signal MUXn is at a low level, the eighth transistor T8 and the tenth transistor T10 are turned on, and the ninth transistor T9 and the eleventh transistor T11 are turned off. When the shunt control signal MUXn is at a high level, the ninth transistor T9 and the eleventh transistor T11 are turned on, and the eighth transistor T8 and the tenth transistor T10 are turned off. Therefore, under control of the shunt control signal MUXn, the signal on the first source signal line SL1 can be transmitted to the data line 001 or 002, respectively, and the signal on the second source signal line SL2 can be transmitted to the data line 003 or 004, respectively, thereby achieving the same function as the signal applying circuit 10 illustrated in FIG. 5. The number of the shunt control signal MUXn of the signal applying circuit 20 is one, so the signal is simple and easy to implement.

In the present embodiment, as illustrated in FIG. 7, the display panel further includes at least one gate driving circuit 400. The gate driving circuit 400 is configured to provide a plurality of gate scanning signals to perform line scanning on the pixel array 300. FIG. 7 illustrates only four gate scanning signals Gout1-Gout4, but it should be understood that the number of the gate scanning signals is not limited thereto. For example, the gate driving circuit 400 may adopt a common form of a plurality of shift register units that are cascaded, so as to output a group of shift signals as the gate scanning signals. For example, the gate driving circuit 400 may be provided on the array substrate of the display panel to constitute a GOA circuit. Of course, the embodiments of the present disclosure are not limited thereto, and the gate driving circuit 400 may also be provided outside the array substrate, for example, connected to scanning lines on the array substrate through a flexible circuit board or the like, so as to perform the line scanning on the pixel array 300.

For example, in the case where the pixel array 300 is driven by the gate driving circuit 400, the gate driving circuit 400 may be provided on one side of the display panel. Of course, the gate driving circuits 400 may also be provided on both sides of the display panel to achieve the bilateral driving. For example, a gate driving circuit 400 may be provided on one side of the display panel for driving odd-numbered rows of scanning lines, and a gate driving circuit 400 may be provided on the other side of the display panel for driving even-numbered rows of scanning lines.

It should be noted that the display panel provided by some embodiments of the present disclosure may be an OLED display panel or a liquid crystal display panel, or may be any other types of display panel, which is not limited in the embodiments of the present disclosure.

At least one embodiment of the present disclosure further provides a display device, which includes the display panel according to any one of the embodiments of the present disclosure. The display device can simplify signals, lower the difficulty of signal adjustment during the process of the cell test, and extend the signal writing time of the sub-pixels under the premise that the frequency is constant (for example, the frequency of the gate scanning signal is constant), which improves the image stability during the process of the cell test.

Figure 9:
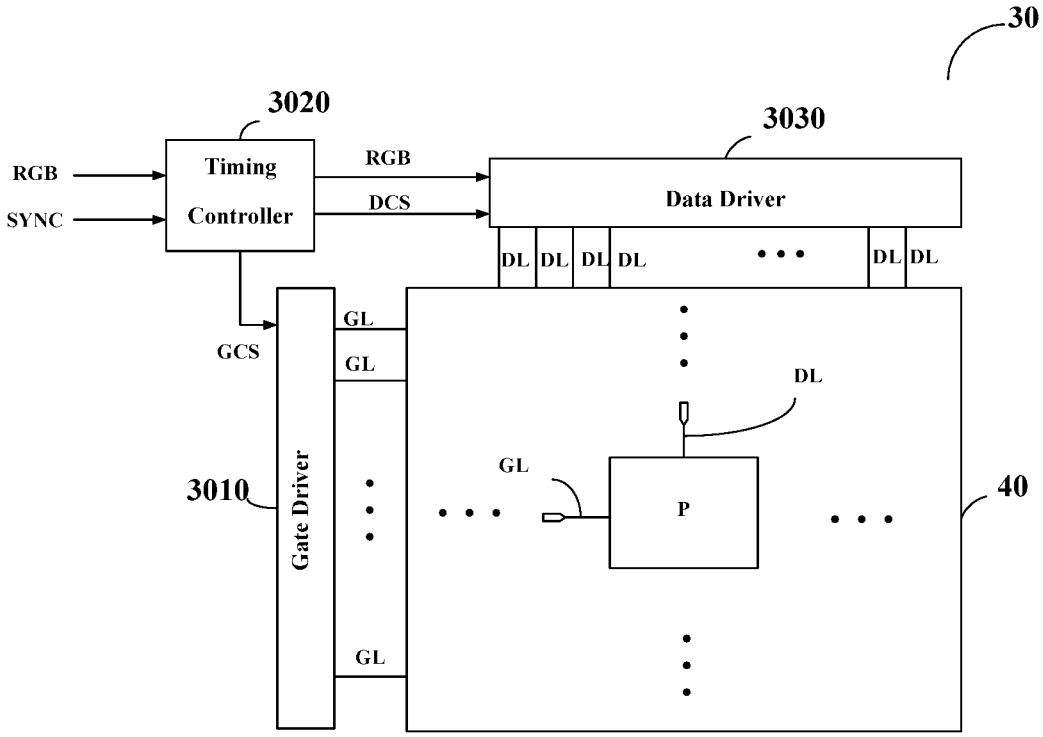
FIG. 9 is a schematic block diagram of a display device provided by some embodiments of the present disclosure.

FIG. 9 is a schematic block diagram of a display device provided by some embodiments of the present disclosure. As illustrated in FIG. 9, a display device 30 includes a display panel 40. The display panel 40 is the display panel described in any one of the embodiments of the present disclosure, and the display panel 40 includes, for example, the signal applying circuit 10/20. For example, the display device 30 may be any products or components having a display function such as a liquid crystal panel, a liquid crystal television, a display, an OLED panel, an OLED television, an electronic paper display device, a mobile phone, a tablet computer, a notebook computer, a digital photo frame, a navigator, and so on, and the embodiments of the present disclosure are not limited thereto. The technical effects of the display device 30 may be referred to the corresponding descriptions of the signal applying circuit 10/20 in the above embodiments, and details are not described here again.

For example, in an example, the display device 30 includes a display panel 40, a gate driver 3010, a timing controller 3020, and a data driver 3030. The display panel 40 includes a plurality of pixel units P defined according to the intersection of a plurality of scanning lines GL and a plurality of data lines DL. The gate driver 3010 is used to drive the plurality of scanning lines GL, and the data driver 3030 is used to drive the plurality of data lines DL. The timing controller 3020 is used to process the image data RGB input from the outside of the display device 30, provide the processed image data RGB to the data driver 3030, and output scanning control signals GCS and data control signals DCS to the gate driver 3010 and the data driver 3030, respectively, so as to control the gate driver 3010 and the data driver 3030.

For example, the gate driver 3010 is correspondingly connected to the plurality of scanning lines GL. The plurality of scanning lines GL are correspondingly connected to the pixel units P arranged in a plurality of rows. The gate driver 3010 sequentially outputs the gate scanning signals to the plurality of scanning lines GL, so the pixel units P arranged in rows in the display panel 40 can perform the progressive scanning. For example, the gate driver 3010 may be implemented as a semiconductor chip, or may be integrated in the display panel 40 to constitute a GOA circuit.

For example, the data driver 3030 converts the digital image data RGB input from the timing controller 3020 into data signals by using a reference gamma voltage, according to the plurality of data control signals DCS from the timing controller 3020. The data driver 3030 provides the converted data signals to the plurality of data lines DL. For example, the data driver 3030 may be implemented as a semiconductor chip.

For example, the timing controller 3020 processes the image data RGB input from the outside to match the size and resolution of the display panel 40, and then provides the processed image data to the data driver 3030. The timing controller 3020 generates a plurality of scanning control signals GCS and a plurality of data control signals DCS using synchronization signals (for example, a dot clock DCLK, a data enable signal DE, a horizontal synchronization signal Hsync, and an vertical synchronization signal Vsync) input from the outside of the display device 30. The timing controller 3020 provides the scanning control signals GCS and the data control signals DCS to the gate driver 3010 and the data driver 3030, respectively, for controlling the gate driver 3010 and the data driver 3030.

The display device 30 may further include other components, for example, a signal decoding circuit, a voltage conversion circuit, and the like. These components may adopt, for example, existing conventional components, and are not described in detail here.

At least one embodiment of the present disclosure further provides a method of driving a display panel, which can be used to drive the display panel according to any one of the embodiments of the present disclosure. By using this method, the signals can be simplified, the difficulty of signal adjustment during the process of the cell test is lowered, and the signal writing time of the sub-pixels under the premise that the frequency is constant (for example, the frequency of the gate scanning signal is constant) is extended, and therefore, the image stability during the process of the cell test is improved.

For example, in an example, the method of driving the display panel includes the following operations:

providing the first control signal, the second control signal, the first data signal, and the second data signal, so as to enable the first input sub-circuit 110 to respectively transmit the first data signal and the second data signal to the first shunt sub-circuit 210 at different times in response to the first control signal and the second control signal, providing the shunt control signal, so as to enable the first shunt sub-circuit 210 to transmit the first data signal from the first input sub-circuit 110 or the second data signal from the first input sub-circuit 110 to the first output terminal OT1 in response to the shunt control signal, or enable the first shunt sub-circuit 210 to transmit the first data signal from the first input sub-circuit 110 or the second data signal from the first input sub-circuit 110 to the second output terminal OT2 in response to the shunt control signal, and providing a gate scanning signal, so as to enable the first data signal to be written into a first color sub-pixel B, and enable the second data signal to be written into a second color sub-pixel R; and providing the third control signal and the third data signal, so as to enable the second input sub-circuit 120 to transmit the third data signal to the second shunt sub-circuit 220 in response to the third control signal, and enable the second shunt sub-circuit 220 to transmit the third data signal from the second input sub-circuit 120 to the third output terminal OT3 or the fourth output terminal OT4 in response to the shunt control signal, the third data signal being written into a third color sub-pixel G under control of the gate scanning signal.

For example, in an example, the shunt control signal includes a first shunt control signal and a second shunt control signal. The first shunt control signal and the second shunt control signal have a same waveform and have different phases, for example, the waveforms of the first shunt control signal MUX1 and the second shunt control signal MUX2 illustrated in FIG. 6.

For example, an effective pulse width interval of the gate scanning signal includes a first sub-interval, a second sub-interval, and a third sub-interval. For example, as illustrated in FIG. 6, the first sub-interval is the first phase S1, the second sub-interval is the first gap interval Marg1, and the third sub-interval is the second phase S2.

A first shunt control signal MUX1 corresponding to the first sub-interval is an invalid level of the first shunt sub-circuit 210 and the second shunt sub-circuit 220, and a second shunt control signal MUX2 corresponding to the first sub-interval is a valid level of the first shunt sub-circuit 210 and the second shunt sub-circuit 220.

A first shunt control signal MUX1 corresponding to the second sub-interval is an invalid level of the first shunt sub-circuit 210 and the second shunt sub-circuit 220, and a second shunt control signal MUX2 corresponding to the second sub-interval is an invalid level of the first shunt sub-circuit 210 and the second shunt sub-circuit 220.

A first shunt control signal MUX1 corresponding to the third sub-interval is a valid level of the first shunt sub-circuit 210 and the second shunt sub-circuit 220, and a second shunt control signal MUX2 corresponding to the third sub-interval is an invalid level of the first shunt sub-circuit 210 and the second shunt sub-circuit 220.

In this way, within the effective pulse width interval of the gate scanning signal, the first color sub-pixels B and the second color sub-pixels R in the same row can be respectively written with corresponding data signals, so as to complete the data writing of the sub-pixels in this row. Moreover, with the second sub-interval, the voltage on the source signal line can be completely transformed to ensure that data is written correctly.

For example, effective pulse width intervals of gate scanning signals, which are provided to adjacent rows of sub-pixels of the pixel array 300 of the display panel, have gap intervals. As illustrated in FIG. 6, there is a second gap interval Marg2 between the gate scanning signal Gout1 and the gate scanning signal Gout2, so the voltage on the source signal line can be completely transformed to ensure that data is written correctly.

It should be noted that, for the detailed description and technical effects of the above-described method, reference can be made to the description of the operation principle of the signal applying circuit 10/20 in the embodiments of the present disclosure, and details are not described here again.

The following statements should be noted.

(1) The accompanying drawings involve only the structure(s) in connection with the embodiment(s) of the present disclosure, and other structure(s) can be referred to common design(s).

(2) In case of no conflict, features in one embodiment or in different embodiments can be combined to obtain new embodiments.

What have been described above are only specific implementations of the present disclosure, the protection scope of the present disclosure is not limited thereto, and the protection scope of the present disclosure should be based on the protection scope of the claims.

What is claimed is:

1. A display panel, comprising a signal applying circuit, wherein the signal applying circuit comprises an input circuit and a shunt circuit, the input circuit comprises a plurality of first input sub-circuits and a plurality of second input sub-circuits, and the shunt circuit comprises a plurality of first shunt sub-circuits and a plurality of second shunt sub-circuits;

a first input sub-circuit of the plurality of first input sub-circuits is correspondingly connected to a first shunt sub-circuit of the plurality of first shunt sub-circuits, and is configured to receive a first data signal and a second data signal, and transmit one of the first data signal and the second data signal to the first shunt sub-circuit in response to a first control signal and a second control signal;

a second input sub-circuit of the plurality of second input sub-circuits is correspondingly connected to a second shunt sub-circuit of the plurality of second shunt sub-circuits, and is configured to receive a third data signal, and transmit the third data signal to the second shunt sub-circuit in response to a third control signal;

the first shunt sub-circuit comprises a first output terminal and a second output terminal, and the first shunt sub-circuit is configured to receive the first data signal or the second data signal, and is configured to transmit the first data signal from the first input sub-circuit or the second data signal from the first input sub-circuit to the first output terminal in response to a shunt control signal, or transmit the first data signal from the first input sub-circuit or the second data signal from the first input sub-circuit to the second output terminal in response to the shunt control signal; and the second shunt sub-circuit comprises a third output terminal and a fourth output terminal, and the second shunt sub-circuit is configured to receive the third data signal, and transmit the third data signal from the second input sub-circuit to the third output terminal or the fourth output terminal in response to the shunt control signal.

2. The display panel according to claim 1, further comprising a pixel array, wherein the pixel array comprises a plurality of first color sub-pixels, a plurality of second color sub-pixels, and a plurality of third color sub-pixels, sub-pixels in odd-numbered rows of the pixel array are cyclically arranged in an order of a first color sub-pixel, a third color sub-pixel, a second color sub-pixel, and the third color sub-pixel, and sub-pixels in even-numbered rows of the pixel array are cyclically arranged in an order of the second color sub-pixel, the third color sub-pixel, the first color sub-pixel, and the third color sub-pixel.

3. The display panel according to claim 2, further comprising a plurality of data lines, wherein the plurality of data lines are correspondingly connected to columns of sub-pixels of the pixel array;

the first output terminal is connected to a data line, which corresponds to a (4N−3)th column of sub-pixels, of the plurality of data lines, and is configured to provide the first data signal or the second data signal to the (4N−3)th column of sub-pixels;

the second output terminal is connected to a data line, which corresponds to a (4N−1)th column of sub-pixels, of the plurality of data lines, and is configured to provide the first data signal or the second data signal to the (4N−1)th column of sub-pixels;

the third output terminal is connected to a data line, which corresponds to a (4N−2)th column of sub-pixels, of the plurality of data lines, and is configured to provide the third data signal to the (4N−2)th column of sub-pixels;

the fourth output terminal is connected to a data line, which corresponds to a (4N)th column of sub-pixels, of the plurality of data lines, and is configured to provide the third data signal to the (4N)th column of sub-pixels; and N is an integer greater than zero.

4. The display panel according to claim 2, wherein the first color sub-pixel is a blue sub-pixel, the second color sub-pixel is a red sub-pixel, and the third color sub-pixel is a green sub-pixel.

5. The display panel according to claim 1, wherein the first input sub-circuit comprises a first transistor and a second transistor;

a gate electrode of the first transistor is connected to a first control signal terminal to receive the first control signal, a first electrode of the first transistor is connected to a first data signal terminal to receive the first data signal, and a second electrode of the first transistor is connected to the first shunt sub-circuit; and a gate electrode of the second transistor is connected to a second control signal terminal to receive the second control signal, a first electrode of the second transistor is connected to a second data signal terminal to receive the second data signal, and a second electrode of the second transistor is connected to the second electrode of the first transistor.

6. The display panel according to claim 1, wherein the second input sub-circuit comprises a third transistor; and a gate electrode of the third transistor is connected to a third control signal terminal to receive the third control signal, a first electrode of the third transistor is connected to a third data signal terminal to receive the third data signal, and a second electrode of the third transistor is connected to the second shunt sub-circuit.

7. The display panel according to claim 1, wherein the shunt control signal comprises a first shunt control signal and a second shunt control signal, the first shunt sub-circuit transmits the first data signal from the first input sub-circuit or the second data signal from the first input sub-circuit to the first output terminal in response to the first shunt control signal and the second shunt control signal, or transmits the first data signal from the first input sub-circuit or the second data signal from the first input sub-circuit to the second output terminal in response to the first shunt control signal and the second shunt control signal, and the second shunt sub-circuit transmits the third data signal from the second input sub-circuit to the third output terminal or the fourth output terminal in response to the first shunt control signal and the second shunt control signal.

8. The display panel according to claim 7, wherein the first shunt sub-circuit comprises a fourth transistor and a fifth transistor;

a gate electrode of the fourth transistor is connected to a first shunt control signal terminal to receive the first shunt control signal, a first electrode of the fourth transistor is connected to the first input sub-circuit, and a second electrode of the fourth transistor is connected to the first output terminal; and a gate electrode of the fifth transistor is connected to a second shunt control signal terminal to receive the second shunt control signal, a first electrode of the fifth transistor is connected to the first electrode of the fourth transistor, and a second electrode of the fifth transistor is connected to the second output terminal.

9. The display panel according to claim 7, wherein the second shunt sub-circuit comprises a sixth transistor and a seventh transistor;

a gate electrode of the sixth transistor is connected to a first shunt control signal terminal to receive the first shunt control signal, a first electrode of the sixth transistor is connected to the second input sub-circuit, and a second electrode of the sixth transistor is connected to the third output terminal; and a gate electrode of the seventh transistor is connected to a second shunt control signal terminal to receive the second shunt control signal, a first electrode of the seventh transistor is connected to the first electrode of the sixth transistor, and a second electrode of the seventh transistor is connected to the fourth output terminal.

10. The display panel according to claim 2, further comprising at least one gate driving circuit, wherein the at least one gate driving circuit is configured to provide a plurality of gate scanning signals to perform line scanning on the pixel array.

11. The display panel according to claim 1, wherein the display panel comprises an organic light emitting diode display panel or a liquid crystal display panel.

12. A display device, comprising the display panel according to claim 1.

13. A method of driving the display panel according to claim 1, comprising:

providing the first control signal, the second control signal, the first data signal, and the second data signal, so as to enable the first input sub-circuit to respectively transmit the first data signal and the second data signal to the first shunt sub-circuit at different times in response to the first control signal and the second control signal, providing the shunt control signal, so as to enable the first shunt sub-circuit to transmit the first data signal from the first input sub-circuit or the second data signal from the first input sub-circuit to the first output terminal in response to the shunt control signal, or to enable the first shunt sub-circuit to transmit the first data signal from the first input sub-circuit or the second data signal from the first input sub-circuit to the second output terminal in response to the shunt control signal, and providing a gate scanning signal, so as to enable the first data signal to be written into a first color sub-pixel and enable the second data signal to be written into a second color sub-pixel; and providing the third control signal and the third data signal, so as to enable the second input sub-circuit to transmit the third data signal to the second shunt sub-circuit in response to the third control signal, and enable the second shunt sub-circuit to transmit the third data signal from the second input sub-circuit to the third output terminal or the fourth output terminal in response to the shunt control signal, the third data signal being written into a third color sub-pixel under control of the gate scanning signal.

14. The method of driving the display panel according to claim 13, wherein the shunt control signal comprises a first shunt control signal and a second shunt control signal, and the first shunt control signal and the second shunt control signal have a same waveform and have different phases.

15. The method of driving the display panel according to claim 14, wherein an effective pulse width interval of the gate scanning signal comprises a first sub-interval, a second sub-interval, and a third sub-interval, a first shunt control signal corresponding to the first sub-interval is an invalid level of the first shunt sub-circuit and the second shunt sub-circuit, a second shunt control signal corresponding to the first sub-interval is a valid level of the first shunt sub-circuit and the second shunt sub-circuit, a first shunt control signal corresponding to the second sub-interval is an invalid level of the first shunt sub-circuit and the second shunt sub-circuit, a second shunt control signal corresponding to the second sub-interval is an invalid level of the first shunt sub-circuit and the second shunt sub-circuit, a first shunt control signal corresponding to the third sub-interval is a valid level of the first shunt sub-circuit and the second shunt sub-circuit, and a second shunt control signal corresponding to the third sub-interval is an invalid level of the first shunt sub-circuit and the second shunt sub-circuit.

16. The method of driving the display panel according to claim 13, wherein effective pulse width intervals of gate scanning signals, which are provided to adjacent rows of sub-pixels of a pixel array of the display panel, have gap intervals.

17. The display panel according to claim 2, wherein the first input sub-circuit comprises a first transistor and a second transistor;

a gate electrode of the first transistor is connected to a first control signal terminal to receive the first control signal, a first electrode of the first transistor is connected to a first data signal terminal to receive the first data signal, and a second electrode of the first transistor is connected to the first shunt sub-circuit; and a gate electrode of the second transistor is connected to a second control signal terminal to receive the second control signal, a first electrode of the second transistor is connected to a second data signal terminal to receive the second data signal, and a second electrode of the second transistor is connected to the second electrode of the first transistor.

18. The display panel according to claim 2, wherein the second input sub-circuit comprises a third transistor; and a gate electrode of the third transistor is connected to a third control signal terminal to receive the third control signal, a first electrode of the third transistor is connected to a third data signal terminal to receive the third data signal, and a second electrode of the third transistor is connected to the second shunt sub-circuit.

19. The display panel according to claim 2, wherein the shunt control signal comprises a first shunt control signal and a second shunt control signal, the first shunt sub-circuit transmits the first data signal from the first input sub-circuit or the second data signal from the first input sub-circuit to the first output terminal in response to the first shunt control signal and the second shunt control signal, or transmits the first data signal from the first input sub-circuit or the second data signal from the first input sub-circuit to the second output terminal in response to the first shunt control signal and the second shunt control signal, and the second shunt sub-circuit transmits the third data signal from the second input sub-circuit to the third output terminal or the fourth output terminal in response to the first shunt control signal and the second shunt control signal.

20. The display panel according to claim 2, wherein the display panel comprises an organic light emitting diode display panel or a liquid crystal display panel.

* * * * *